US006398616B1

(12) United States Patent
Motosko, III

(10) Patent No.: US 6,398,616 B1
(45) Date of Patent: Jun. 4, 2002

(54) INFLATABLE BALL WITH UNPREDICTABLE MOVEMENT

(76) Inventor: Stephen J. Motosko, III, 132 Sand Dollar La., Sarasota, FL (US) 34242

( * ) Notice: Subject to any disclaimer, the term of this patent is extended or adjusted under 35 U.S.C. 154(b) by 0 days.

(21) Appl. No.: 09/946,124

(22) Filed: Sep. 4, 2001

(51) Int. Cl.[7] ..... A63H 17/00

(52) U.S. Cl. ..... 446/220; 446/437; 473/594; 473/595

(58) Field of Search ..... 446/220, 221, 446/222, 224, 225, 437; 273/DIG. 20; 473/594, 595

(56) References Cited

U.S. PATENT DOCUMENTS

| | | | | |
|---|---|---|---|---|
| 495,863 A | | 4/1893 | Whitzel | |
| 3,060,634 A | | 10/1962 | Fisher | |
| 3,655,197 A | | 4/1972 | Milbaum | |
| 3,995,855 A | | 12/1976 | Schultz | |
| 4,192,094 A | | 3/1980 | Johnson | |
| 4,609,196 A | * | 9/1986 | Bozinovic | 446/437 |
| 4,842,563 A | | 6/1989 | Russell | |
| 4,974,844 A | * | 12/1990 | Richards | 273/DIG. 20 |
| 5,070,610 A | * | 12/1991 | Leslie | 29/899.1 |
| 5,358,448 A | | 10/1994 | Stephens | |
| 6,056,622 A | | 5/2000 | Chung | |
| 6,158,390 A | | 12/2000 | Holtier et al. | |

* cited by examiner

*Primary Examiner*—Jacob K. Ackun
(74) *Attorney, Agent, or Firm*—Charles J. Prescott

(57) ABSTRACT

An inflatable or inflated ball comprising an outer chamber formed of an airtight flexible outer skin which, when properly inflated and fully expanded, defines an interior volume. A sealed inner chamber filled or fillable with a substance substantially heavier than air is positioned within and occupies a relatively small amount of the interior volume. A plurality of elongated radially extending and three-dimensionally spaced elastic members are each connected and radially extend between, the inner chamber and the inner surface of the outer chamber. The elastic members are cooperatively sized in length and suitably tensioned to support and hold the inner chamber centrally in an at-rest position within the interior volume. Each of the elastic members will cooperatively stretch and contact in response to ball movement, such as rolling or being thrown and impact of the ball against a surface, causing the inner chamber to be unpredictably displaced from the at-rest position by gravity and inertia resulting in erratic movement of the ball.

13 Claims, 4 Drawing Sheets

INFLATABLE BALL WITH UNPREDICTABLE MOVEMENT

BACKGROUND OF THE INVENTION

1. Scope of Invention

This invention relates generally to toy balls, and more particularly to an inflatable or inflated toy ball of the type used for recreational purposes and still more particularly to an inflatable toy ball which exhibits eccentric, erratic or unpredictable movement and flight characteristics for enhanced playing pleasure.

2. Prior Art

Inflatable balls such as beach balls and the like are well known and have enjoyed wide spread world wide marketing success for years. Inflatable balls are typically constructed of a thin flexible outer skin such as thin sheet plastic, rubber and the like. Because of the lightweight structure and elasticity of the inflated ball, the bouncing and throwing characteristics are very appealing and unpredictable.

A number of devices associated with spherical balls of the inflatable and of the rigid or semi-rigid outer skin type are known to applicant in prior art as follows:

U.S. Pat. No. 6,056,622 to Chung

U.S. Pat. No. 6,158,390 to Holtier

U.S. Pat. No. 4,842,563 to Russell

U.S. Pat. No. 495,863 to Whitzell

U.S. Pat. No. 3,995,855 to Schultz

U.S. Pat. No. 5,358,448 to Stephens

U.S. Pat. No. 3,655,197 to Milbaum

U.S. Pat. No. 4,192,094 to Johnson

U.S. Pat. No. 3,060,634 to Fisher

Of particular note, the '563 patent to Russell teaches an inflatable ball with a swingable variable internal bladder which, when filled with water, will cause the inflatable ball to move in an erratic fashion for greater playing enjoyment. The movement is typically described as being orbital in nature.

Holtier, in the '390 patent, also teaches a toy ball especially useful for pets which includes a suspended weight positioned. at the center of a tensionable elastic member. The outer chamber is formed of rigid plastic semi-spheres.

In the '622 patent, Chung also teaches a toy ball with unpredictable bounce which includes a second ball positioned within the interior volume of the larger outer ball with the inner ball formed of denser sponge or rubber-like material and held within the interior of the outer ball with its center of gravity offset from the geometric center of the outer air-filled ball.

The present invention teaches an inflatable or permanently inflated toy ball which also exhibits unpredictable and erratic movement during rolling, throwing and impact motion. This toy ball includes an outer skin forming an outer chamber filled with sufficient air to fully expand the outer skin and a sealed inner chamber filled with a substance having a density or weight greater than that of air. This inner chamber is held in position within the interior volume of the outer chamber by elastic members which extend in all radial substantially orthogonal or three dimensional directions from the inner sealed chamber so as to provide universal movement from the at-rest central position of the inner chamber when the toy ball is thrown, rolled, struck or strikes an object such as the ground.

BRIEF SUMMARY OF THE INVENTION

This invention is directed to an inflatable or inflated ball comprising an outer chamber formed of an air tight flexible outer skin which, when properly inflated and fully expanded, defines an interior volume. A sealed inner chamber. filled or fillable with a substance substantially heavier than air is positioned within and occupies a relatively small amount of the interior volume. A plurality of elongated radially extending and three-dimensionally spaced elastic members are each connected and radially extend between, the inner chamber and the inner surface of the outer chamber. The elastic members are cooperatively sized in length and suitably tensioned to support and hold the inner chamber centrally in an at-rest position within the interior volume. Each of the elastic members will cooperatively stretch and contact in response to ball movement, such as rolling or being thrown and impact of the ball against a surface, causing the inner chamber to be unpredictably displaced from the at-rest position by gravity and inertia resulting in erratic movement of the ball.

It is therefore an object of this invention to provide an air-filled ball which exhibits a high degree of bounce from surfaces at which the ball is tossed or thrown and which also exhibits erratic and unpredictable movement as the ball is rolled, thrown or has impact with other objects.

It is another object of this invention to provide an inflatable ball having either a spherical or an ellipsoidal-type elongated outer chamber shape with similar size and shape variations with respect to a much smaller inner chamber which is filled with a heavier material than that of the air which inflates the outer chamber.

Yet another object of this invention is to provide an inflatable ball which includes a weighted inner chamber which is elastically moveable in all directions within the outer chamber so that the ball will freely move in response to gravity and inertial forces applied to the ball to effect unpredictable and erratic movement of the ball during play.

In accordance with these and other objects which will become apparent hereinafter, the instant invention will now be described with reference to the accompanying drawings.

DETAILED DESCRIPTION OF THE INVENTION

Figure 1:
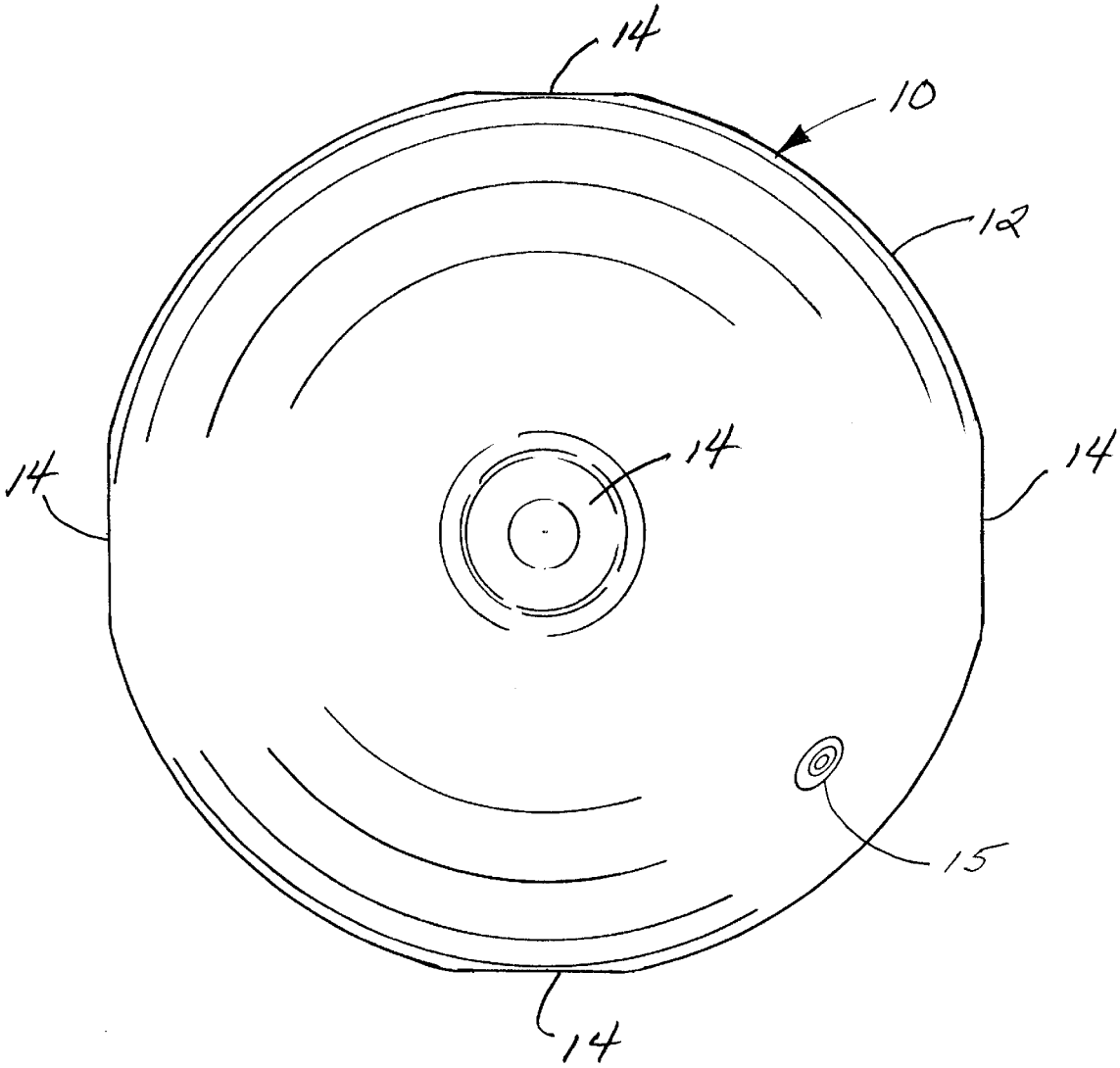
FIG. 1 is a front elevation view of the preferred embodiment of the invention.
Figure 2:
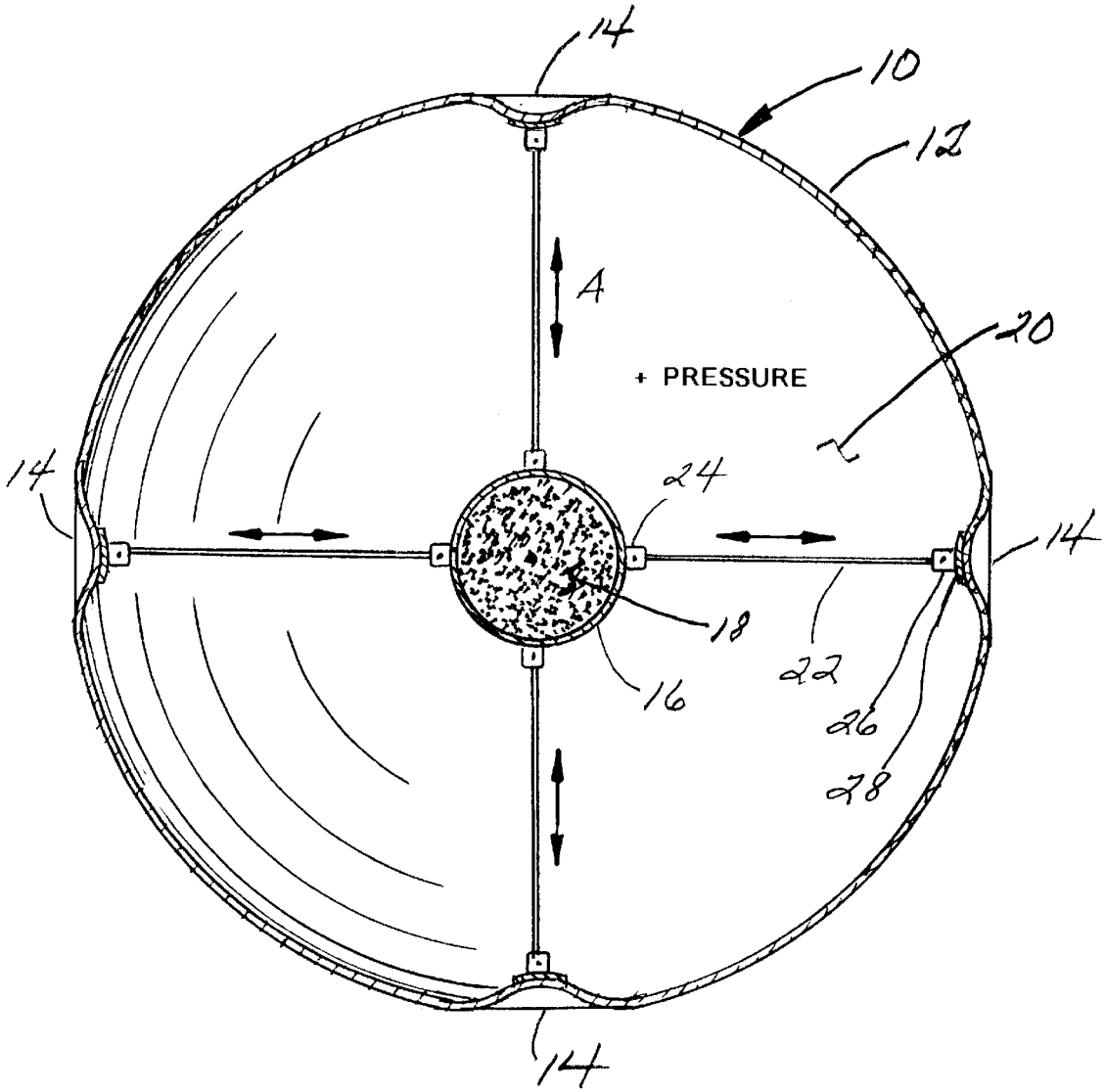
FIG. 2 is a partial section view of the invention as shown in FIG. 1.
Figure 3:
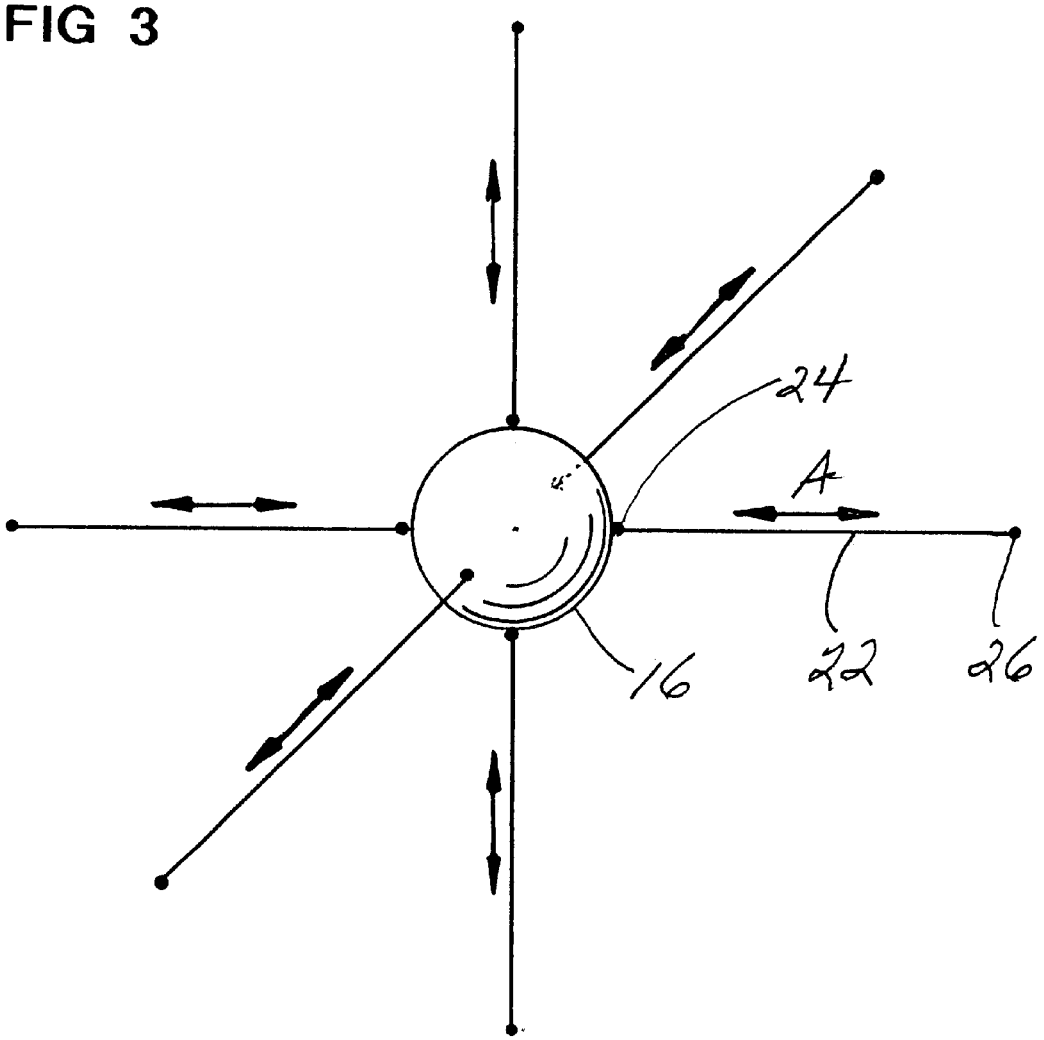
FIG. 3 is a schematic view of the inner chamber and its elastic support members of the invention as shown in FIG. 1 absent the outer flexible skin for clarity.

Referring now to the drawings, and particularly to FIGS. 1 to 3, the preferred embodiment is there shown generally at numeral 10 in FIGS. 1 and 2. This inflatable ball includes a sealed outer flexible skin 12 formed of thin resilient airtight sheet plastic having a sealable fill valve 15 formed therein for inflating the outer skin 12 to the shape shown. Utilizing current technology as an alternate embodiment, the outer skin 12 may be made completely sealed absent the fill valve 15 with filling of air to expand the outer skin 12 to its full pressurized size accomplished at manufacture by minute skin-piercing and by other means whereby the opening made during air filling is permanently sealed thereafter.

The ball 10, as best seen in FIGS. 2 and 3, includes an inner chamber 16 which is filled with material which is heavier or denser than that of air. In this embodiment 10, the inner chamber 16 is filled with a particulate material 18 such as sand or loose gravel for economy. Water and other economical liquids, particulates or solid materials with this density property are envisioned.

The weighted inner chamber 16 is held centrally within the interior volume 20 when at rest by elongated elastic members 22 which are suitably tensioned and connected at their outer end 26 to the inner surface at 14 of the outer skin 12. The inner end of each of the elastic members 22 is connected to the outer surface at 24 of the inner chamber 16. The attachment 26 is reinforced by a separate piece of flexible plastic material 28 for added strength. All mating surfaces are permanently bonded chemically or by heat.

As best seen in FIGS. 2 and 3, when the inner chamber 16 is at rest, equal and opposite forces are applied to hold the inner chamber 16 in the position centrally shown within the interior volume 20. In this case, substantially all of the elastic members 22 are exerting a similar force between the outer skin at all points of attachment 14 and the outer surface of the inner chamber 16.

Note importantly that, as best seen in FIG. 3, the inner chamber 16 is supported in all three dimensional or orthogonal directions on six separate points of attachment 14 onto the inner surface of the outer skin and a corresponding number of elastic members 22. Although variations of the orthogonal orientation with respect to each of the six elastic members 22 shown in FIG. 2 are possible, the important aspect is that the inner chamber 16 is elastically supported and moveable with respect to the outer skin 12 in virtually all directions in response to movement of the ball 10, inertia impact against a surface and rolling motion. In such instance, the inner chamber 16 will move erratically or unpredictably exerting variable forces upon each of the elastic members 22 and causing the center of gravity of the inner chamber 16 to be displaced from its at-rest position in the direction of arrows A to cause the unpredictable motion of the ball 10.

Figure 4:
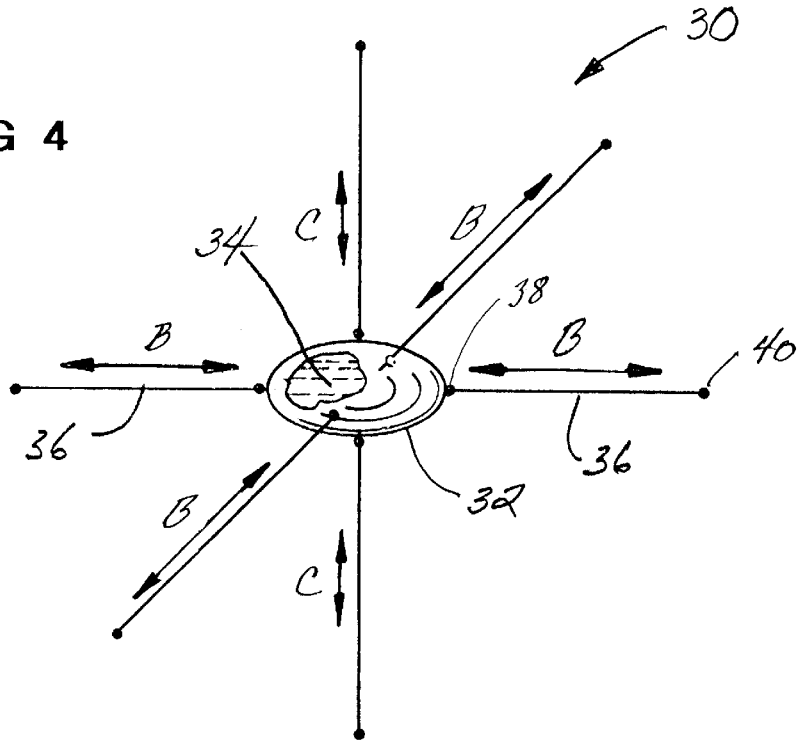
FIG. 4 is a view similar to that of FIG. 3 showing an alternate elongated shape embodiment of the inner chamber.

Referring now to FIG. 4, an alternate embodiment of the invention is there shown at numeral 30 absent the outer skin for clarity. In this embodiment 30, the inner chamber is elongated in one place and preferably ellipsoidal and is sealingly filed with water 34 for economy. Because the inner chamber is ellipsoidal, non-uniform movement in response to the same applied force in a particular direction at B and C is present. This variation of the invention thus offers an alternate aspect to the unpredictability of movement of the inflatable ball 30.

Figure 5:
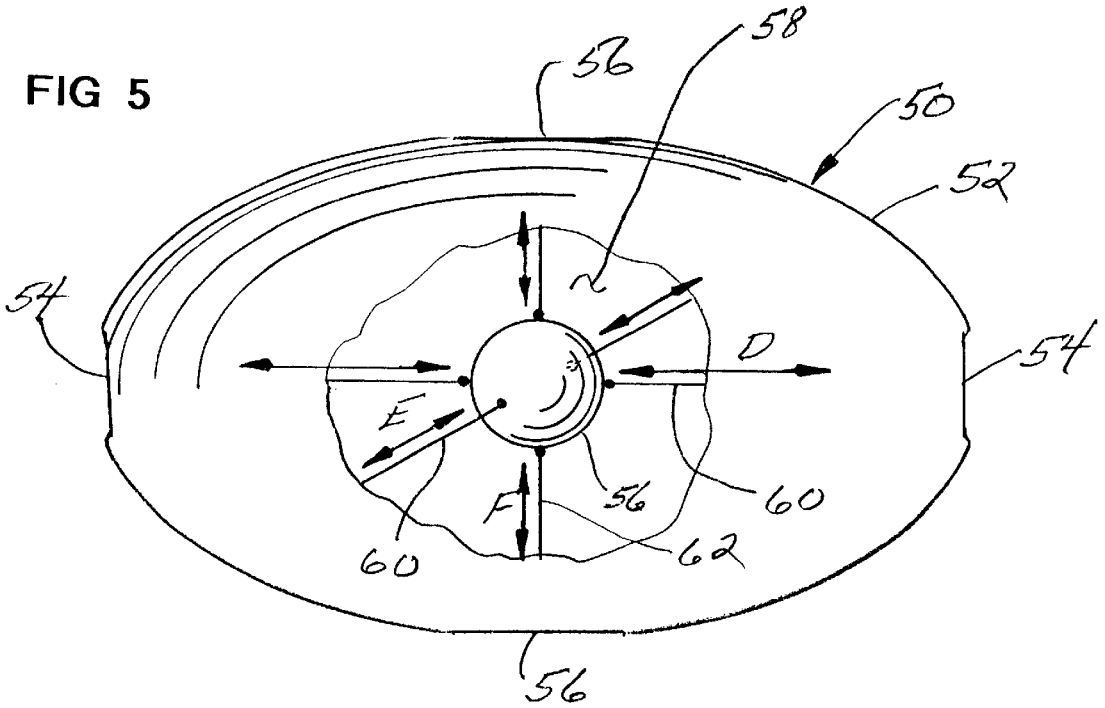
FIG. 5 is a side elevation partially broken view of another embodiment of the invention showing an alternate elongated shape of the outer chamber.

Another variation of the invention is shown in FIG. 5 generally at numeral 50. In this embodiment 50, the flexible airtight outer skin 52 is formed generally as an elongated ellipsoid with the inner chamber 56 having a generally spherical configuration filled with a weighted material having a density greater than that of air.

Again, six orthogonally oriented elastic members 60 and 62 support the inner chamber 56 by corresponding attachment at points 54 and 56 of the inner surface of the outer skin. Non-uniform elastic displacements shown generally at D, E and F are typically experienced by the inner chamber 56 so as to provide still further variations of unpredictability of movement as the ball 50 is thrown, rolled or impacted against a surface. The uniformly weighted inner chamber 56 will be displaced from its at-rest position in non-uniform fashion depending upon the forces of inertia and motion imparted to it through the variable lengths of elastic members 60 and 62 depending upon the dissimilar orthogonal outer dimensions selected for the outer skin 52.

Note again that the elastic members may be oriented non-orthogonally one to another so long as three-dimensional supported displacement of the weighted inner chamber is provided.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. An inflatable ball comprising:

an inflatable outer chamber formed of an air tight flexible outer skin which, when inflated, defines an interior volume;

a sealed inner chamber filled with a substance substantially heavier than air and occupying a relatively small amount of said interior volume;

a plurality of elongated elastic members radially extending and evenly spaced apart in all three dimensions, each elastic member of said plurality connected to, and extending between, said inner chamber at one end thereof and to an inner surface of said outer chamber at another end thereof;

said plurality of elastic members cooperatively sized in length and suitably tensioned, when said outer chamber is substantially fully inflated, to support and hold said inner chamber centrally in an at-rest position within said interior volume;

each of said plurality of elastic members cooperatively stretching and contracting within said interior volume in response to movement and impact of said ball causing said inner chamber to be unpredictably displaced from the at-rest position by gravity and inertia resulting in erratic movement of said ball.

2. An inflatable ball as set forth in claim 1, wherein:

said outer chamber is spherical.

3. An inflatable ball as set forth in claim 1, wherein:

said outer chamber is elongated having a generally ellipsoidal shape.

4. An inflatable ball as set forth in claim 1, wherein:

said inner chamber is spherical.

5. An inflatable ball as set forth in claim 1, wherein:

said inner chamber is elongated having a generally ellipsoidal shape.

6. An inflatable ball as set forth in claim 1, wherein:

said inner chamber is non-uniform in weight distribution about a center of gravity of said inner chamber.

7. An inflatable ball comprising:

an outer chamber formed of an airtight flexible outer skin which defines an interior volume which is filled or fillable with air;

a sealed inner chamber which is filled or fillable with a substance substantially heavier than air and, when so filled, occupying a relatively small amount of said interior volume;

a plurality of elongated elastic members each of which is connected to, and radially extending substantially orthogonally or coaxially one to another between said inner bladder at one end thereof and to an inner surface of said outer chamber at another end thereof;

said plurality of elastic members cooperatively sized in length and suitably tensioned to support and hold said inner chamber centrally in an at-rest position within said interior volume;

each of said plurality of elastic members cooperatively exerting a variable elastic force upon said inner chamber in response to movement and impact of said ball, causing said inner chamber to be unpredictably displaced from the at-rest position by gravity and inertia resulting in erratic movement of said ball.

8. An inflatable ball as set forth in claim 7, wherein:

said outer chamber is spherical.

9. An inflatable ball as set forth in claim 7, wherein:

said outer chamber is elongated having a generally ellipsoidal shape.

10. An inflatable ball as set forth in claim 7, wherein:

said inner chamber is spherical.

11. An inflatable ball as set forth in claim 7, wherein:

said inner chamber is elongated having a generally ellipsoidal shape.

12. An inflatable ball as set forth in claim 7, wherein:

said inner chamber is non-uniform in weight distribution about a center of gravity of said inner chamber.

13. An inflatable ball as set forth in claim 7, wherein:

said plurality is six forming three pairs of said elastic members, each of said elastic members of each said pair substantially coaxial one to another.

* * * * *